United States Patent [19]

Miskin

[11] 3,963,376

[45] June 15, 1976

[54] AUTOMATIC WATER POWERED SUMP DRAINER

[76] Inventor: David M. Miskin, 8 Still Lane, West Hartford, Conn. 06117

[22] Filed: June 5, 1975

[21] Appl. No.: 583,953

Related U.S. Application Data

[63] Continuation-in-part of Ser. No. 487,904, July 12, 1974, abandoned.

[52] U.S. Cl. ..... 417/40; 417/89; 417/182.5; 417/211.5; 417/505

[51] Int. Cl.[2] ..... F04F 5/48; F04B 49/04

[58] Field of Search ..... 417/211.5, 182.5, 87, 417/89, 40, 505; 137/409

[56] References Cited

UNITED STATES PATENTS

| | | | |
|---|---|---|---|
| 998,647 | 7/1911 | Smith | 417/211.5 |
| 1,177,270 | 3/1916 | Pursell | 417/182.5 |
| 1,230,972 | 6/1917 | Woodworth | 417/182.5 |
| 1,988,656 | 1/1935 | Henderson | 417/87 X |

*Primary Examiner*—Carlton R. Croyle
*Assistant Examiner*—Richard E. Gluck

[57] ABSTRACT

An automatic water powered sump drainer comprises valve means, a float assembly, a venturi, means connecting one side of the sump drainer to a water supply, and means connecting the other side of the sump drainer to a drain outlet. The valve means is supported in spaced relation to a sump hole and has operatively connected thereto the float assembly which includes a float ball positioned within a sump hole and connected to the valve means for movement between two extreme positions. Motion of the float ball is transmitted to the valve means and effects movement of a permanent magnet therein which in conjunction with armature means controls a diaphragm which opens or closes a through passage in the valve means. The venturi is formed in this through passage and is operable to cause water located in a sump hole to be withdrawn therefrom. Tube means have one end connected in fluid flow relation with the through passage in the valve body on the downstream side of the venturi and in close relation thereto, the other end thereof lying below the water level in a sump hole and preferably having an anti-clog screen mounted thereabout.

13 Claims, 8 Drawing Figures

AUTOMATIC WATER POWERED SUMP DRAINER

RELATED APPLICATION

This application is a continuation-in-part of my copending application, Ser. No. 487,904, filed July 12, 1974, now abandoned.

BACKGROUND OF THE INVENTION

It is a very common practice found employed in the construction of buldings to provide a sump hole in the floor of the basement thereof. This sump hole functions as a collection point for water which enters the basement in the form of leaks through the foundation of the building, or which accumulates in the basement from any other source. Once water has collected in the sump hole there are a variety of ways by which it can be removed therefrom. For example, where only a small amount of water needs to be removed from the sump hole, this can be accomplished simply by permitting the water to drain from the sump hole into the soil under the building with which the sump hole is in communication. In other instances, the sump hole has connected thereto some form of conduit means which is connected in fluid circuit relation with an external drainage system whereby as water collects in the sump hole, when it reaches the level of the aforesaid conduit means, it flows therethrough to the exterior of the building from whence it is fed into some type of drainage system provided for this purpose externally of the building.

More commonly, however, the water which collects in the sump hole is withdrawn therefrom through the use of some type of sump pump. Sump pumps may be classified according to the means by which they are powered, namely, those which are electrically operated and those which are powered by some other form of prime mover such as a gasoline engine, etc. In addition, sump pumps may be categorized according to the manner in which the operation thereof is initiated. For example, it is known to provide sump pumps wherein the operation thereof is automatically initiated upon the occurrence of some condition, while there are other sump pumps which require a manual act to be performed such as throwing a switch, or starting a gasoline engine, etc. for purposes of initiating the operation thereof. Finally, there are sump pumps which are intended to be permanently installed in a sump hole thereby to be ever ready for use, while there are those which are designed to be stored elsewhere and then positioned in the sump hole as the need therefor arises.

Notwithstanding the fact that there have been provided heretofore a multiplicity of different forms of sump pumps each operable for purposes of draining water from a sump hole, a need has nevertheless existed to provide a sump pump which will be automatic in its operation in times of emergency. Namely, a specific need has been evidenced to provide a sump drainer which would be capable of functioning under conditions existing in situations such as that which was actually experienced during recent months as described hereinafter. More particularly, this past winter one section of the country was hit by a severe ice storm which caused a number of trees to fall as well as limbs thereof to break because of the added weight applied thereto by the ice. As the limbs broke and/or the trees fell, in many instances they carried with them power lines. Moreover, no sooner was power restored then another limb broke or a tree fell once again knocking out power in that same area. Consequently, the effect thereof was to cause a number of communities in this particular section of the country to be without power for prolonged periods which resulted in large numbers of people being forced to evacuate their homes. At the same time, this section of the country experienced a spell of extreme cold weather. The combination of no power and the cold caused the temperature in many residences as well as commercial buildings to fall below freezing. As a result, many people experienced burst water pipes which led to flooding and severe damage being done to washers, dryers, electric furnaces, etc., located in the basements of these buildings. Electric sump pumps which normally would have been employed in order to drain the water from the flooded basements were inoperable because no electricity was available to power them. On the other hand, for those who possessed sump pumps which employed as a power source some means other than electricity, the problem was that these sump pumps most often had to be manually started. However, in many instances the extreme cold which caused the pipes to burst had also caused the residents of the dwellings to evacuate their homes. Therefore, no one was present to manually start the sump pumps when the need therefor arose. It thus became readily apparent that there was a need for a sump drainer which possessed the capability of permitting the operation thereof to be automatically initiated when the need thereof arose and which employed as a power source some means other than electricity.

Accordingly, it is an object of the present invention to provide a novel and improved sump drainer which is operable to drain water which has collected in a sump hole provided in the basement floor of a building therefrom.

It is another object of the present invention to provide such a sump drainer wherein the operation thereof is capable of being automatically initiated upon the occurrence of some predetermined condition.

A further object of the present invention is to provide such a sump drainer which employs water as a power source and therefore remains operable during periods of electrical power outages.

A still further object of the present invention is to provide such a sump drainer which is readily compatible with the existing equipment to be found in present buildings, be the latter in the nature of a residential building or a commercial building, thereby enabling the sump drainer of the present invention to be installed therein without necessitating either extensive modification of existing equipment or the addition of new equipment.

Yet another object of the present invention is to provide such a sump drainer which is capable of being easily installed in a building by the average person.

Yet still another object of the present invention is to provide such a sump drainer which is characterized by the fact that it embodies components which are presently commercially available.

SUMMARY OF THE INVENTION

It has now been found that the foregoing and related objects can be readily attained in an automatic water powered sump drainer which is particularly suited for pumping water out of basement sump holes when a power failure or motor burnout on an existing electric sump pump occurs. The major components to be found employed in the automatic water powered sump drainer of the present invention are valve means, a float assembly, a venturi means connecting one side of the sump drainer to a suitable water supply, and means connecting the other side of the sump drainer to a suitable drain outlet. The valve means is suitably supported in spaced relation to the sump hole in a basement, and has operatively connected thereto the float assembly. The latter float assembly includes means which is positioned within the sump hole and is suitably connected to the valve means so as to be capable of moving between a first position and a second position within the sump hole. As the latter means moves from its first position to its second position, the motion thereof is transmitted from the float assembly to the valve means and is effective to cause the latter to move from a closed condition to an open condition. The means connecting one side of the sump drainer to a water supply has one end thereof connected to the water supply and the other end connected to the inlet side of the valve means. Similarly, the means connecting the other side of the sump drainer to the drain outlet has one end thereof connected to the outlet side of the valve means and the other end connected to the drain outlet. The venturi is connected in fluid circuit relation with the valve means and is operable to cause water located in sump holes to be withdrawn therefrom. The automatic water powered sump drainer functions in the following manner. When flooding occurs, in response to a rise in the level of the water in the sump hole, the float assembly is actuated. This in turn causes the valve means to open thereby permitting water from the water supply to flow through the valve means past the venturi siphon to the drain outlet. In accordance with the venturi principle, as water flows through the siphon, a suction is established which is effective to cause the water in the sump hole to be drained therefrom.

In accord with the preferred embodiment of the invention, the valve means includes a permanent magnet which is movable to a position wherein the permanent magnet encircles an armature means, the latter in turn being operative to normally apply a biasing force to a diaphragm which is effective to cause the diaphragm to close off a through passage in the valve body which is also provided as a portion of the valve means. When the permanent magnet encircles the armature means, the magnetic field of the former is operative to pull the armature means away from the diaphragm to release the biasing force being applied thereby and to cause the diaphragm to occupy a position relative to the valve body wherein the through passage therethrough is opened. The means of the float assembly which is movable within the sump hole comprises a float ball. The float ball is attached to the end of an elongated member which in turn is operatively connected to the valve means so as to control the opening and the closing of the latter. The means connecting one side of the sump drainer to the water supply comprises a length of hose appropriately connected at one end to a form of fitting with which the inlet side of the valve means is provided. The other side of the aforereferenced hose is connected to a flood stopper which in turn is connected to a suitable water supply such as a conventional water spigot. The flood stopper comprises a conventional form of device which is operable to shut off the flood of water from the spigot, when the latter is left ON, through the length of hose in the event that the latter should burst. The means connecting the other side of the sump drainer to the drain outlet consists of a length of hose having one end thereof located so as to be in communication with a suitable drain outlet. The other end of the aforereferenced length of hose is connected to the valve means so as to be in fluid flow relation with one side of the venturi. The venturi in turn is formed in the through passage which is provided in the valve body of the valve means. To enable the venturi to operate to withdraw water from the sump hole, tube means are provided having one end connected to fluid flow relation with the through passage in the valve body and so as to be located on the downstream side of the venturi provided therein in close proximity thereto. The other end of the tube means is positionable within the sump hole so as to be located below the surface of the water contained therein. Preferably, an anti-clog screen is suitably mounted on the tube means in juxtaposed relation to the end thereof through which the water in the sump hole is withdrawn, as a means of preventing undesired material from accumulating in the tube means and thereby causing a clogging thereof.

DETAILED DESCRIPTION OF THE ILLUSTRATED EMBODIMENTS

Figure 1:
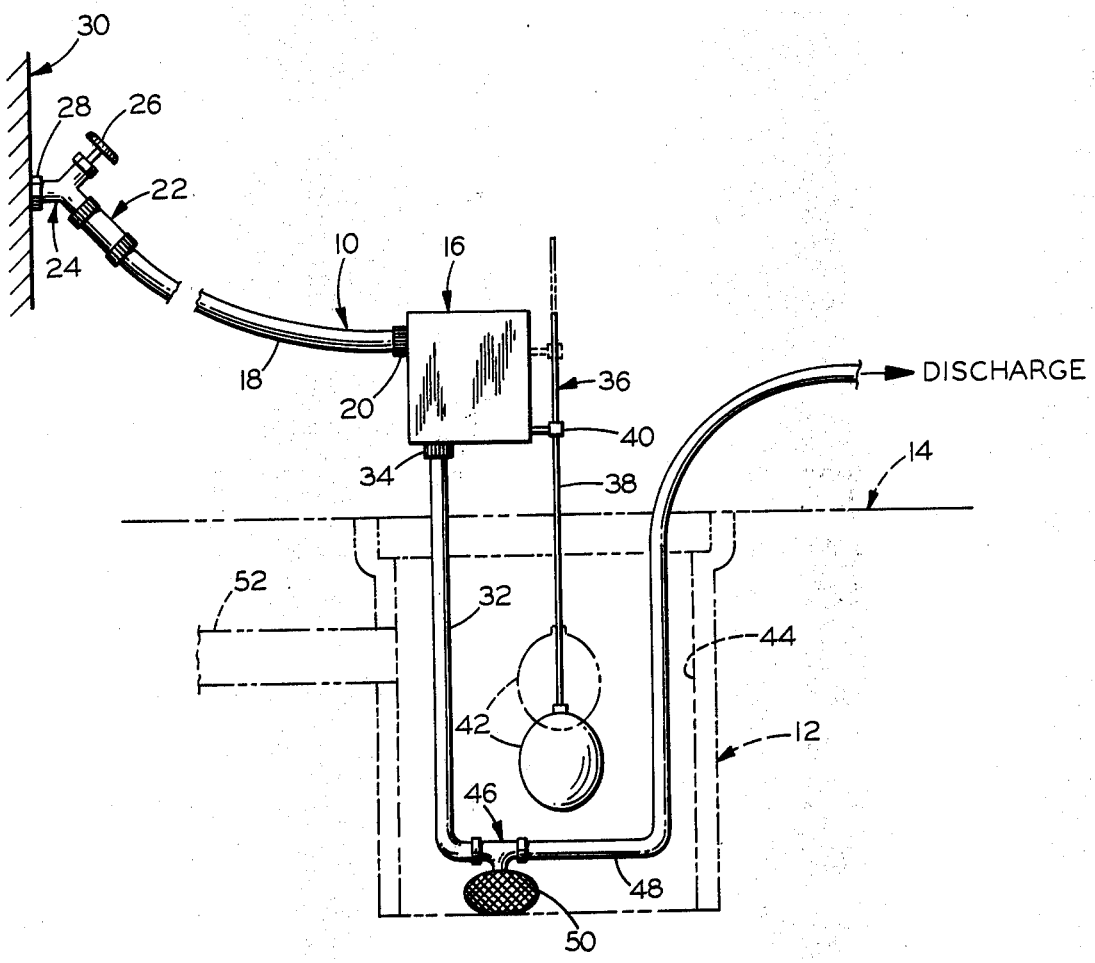
FIG. 1 is a schematic diagram of one embodiment of an automatic water powered sump drainer constructed in accordance with the present invention.

Referring now to the figures of the drawings, and more particularly to FIG. 1 thereof, there is depicted therein a schematic diagram of one embodiment of an automatic water powered sump drainer, generally designated by reference numeral 10, constructed in accordance with the present invention, which is particularly suited for use in pumping water out of basement sump holes when a power failure or motor burnout on an existing electric sump pump occurs. For purposes of the following description, the sump drainer 10 is shown illustrated in FIG. 1 of the drawings associated with a sump hole, generally designated in FIG. 1 by reference numeral 12 which in turn is suitably provided in the floor, the latter being schematically represented in FIG. 1 of the drawings by the line identified therein through the use of reference numeral 14 of a building.

The sump drainer 10 includes valve means 16 comprising a float valve supported externally of the sump hole 12 in spaced relation thereto. The means utilized for accomplishing the aforereferenced supporting of the float valve 16 relative to the sump hole 12 has not been illustrated in FIG. 1 of the drawings in the interest of maintaining clarity of illustration therein. It is however to be understood that any suitable conventional form of means commonly found employed for purposes of rigidly supporting a device relative to an object could be utilized in this connection. Namely, the float valve 16 could, for example, be attached to a suitably configured bracket member which in turn was secured to the floor 14 of the building adjacent an edge of the sump hole 12.

Inasmuch as the float valve 16 may embody the construction of any of the commercial forms thereof which are presently being marketed and since the nature of the construction of all of these devices is well-known to those skilled in the present art, it has not been deemed necessary to include herein a detailed description of the internal construction of the float valve 16 for one to obtain an understanding of the present invention. Rather, it is deemed sufficient to merely note that the float valve 16 embodies a construction which is operable to provide the float valve 16 with a closed valve condition wherein fluid which is supplied to the inlet of the float valve 16 is prevented from flowing therethrough and an open valve condition wherein fluid which is supplied to the inlet of the float valve 16 is permitted to flow therethrough and to exit from the outlet thereof.

As seen with reference to FIG. 1 of the drawings, the float valve 16 has connected thereto on one side thereof one end of a length of hose 18. More specifically, one end of the length of hose 18 is connected to a suitable fitting 20 of conventional construction which, in accord with well-known practice, functions as an interface between the end of the hose 18 and the opening (not shown) which forms the inlet to the float valve 16. The other end of the length of hose 18 is connected to one side of a flood stopper 22. The latter flood stopper 22 comprises a device which is operable to shut off the flow of fluid being supplied to the length of hose 18 for passage therethrough in the event that the latter for any reason should burst. The nature of the construction of the flood stopper 22 as well as the mode of operation thereof is well-known to those skilled in the art. Consequently, it is not deemed necessary to set forth herein a detailed description thereof for one to obtain an understanding of the present invention. However, if so desired, for purposes of obtaining further information regarding the nature of the construction and/or the mode of operation of the flood stopper 22 reference may be had in this regard to U.S. Pat. No. 3,441,052 wherein there is described and illustrated one form of such a device. The other side of the flood stopper 22 is in turn connected to a water spigot which is generally designated in FIG. 1 by the reference numeral 24. It can thus be seen that the length of hose 18 and the flood stopper 22 constitute the means for connecting the sump drainer 10 to a suitable water supply, namely, the water spigot 24.

As illustrated in FIG. 1 of the drawings, the spigot 24 embodies a handle 26 through the operation of which the spigot 24 may be placed in an open, i.e., ON condition, wherein fluid is permitted to flow through the spigot 24 and a closed, i.e., OFF, condition wherein flow of fluid through the spigot 24 is prevented. The spigot 24 is connected by means of fitting 28 to one end of a pipe (not shown) wherein fluid, in this case water, is carried from a source thereof located externally of the building through the foundation 30 thereof, which is schematically depicted in FIG. 1 of the drawings, to the interior of the building and, more specifically, to the spigot 24 from whence it is dispensed. Although for purposes of illustration of the invention, one side of the sump drainer 10 has been depicted as being connected to a water spigot, i.e., the spigot 24, it is to be understood that the water supply may take the form of some other type of means without departing from the essence of the invention. In this regard, the important consideration is that one side of the sump drainer 10 is connected to a water supply and not the specific form which the latter may take.

Referring again to FIG. 1 of the drawings, the opening (not shown), which is formed in the float valve 16 and which functions as an outlet therefrom for fluid permitted to flow therethrough, is connected to one end of a connecting hose 32 by means of a fitting 34. The latter fitting 34 functions as an interface between the float valve 16 and one end of the hose 32. To this end, the fitting 34 is similar in construction to the fitting 20 which was described previously hereinabove. The other end of the connecting hose 32 is connected to one side of the venturi 46 to which further reference will be had subsequently.

The sump drainer 10 as depicted in FIG. 1 includes a float assembly 36. The latter includes an elongated member 38 which is operatively connected intermediate its ends in a manner well-known to those skilled in the art by means of a support 40 to the float valve 16. At one end thereof the member 38 has attached thereto a float ball 42. As best understood with reference to FIG. 1 of the drawings, the float ball 42 and thereby the member 38 are movable between a first position depicted in FIG. 1 in broken lines and a second position thereof shown in solid lines. More particularly, the member 38 is supported from the float valve 16 so that the end thereof which carries the float ball 42 is positioned within the interior of the sump hole 12. Consequently, as water accumulates in the sump hole 12, the effect thereof is to cause the float ball 42 to rise with the level of the water. As the float ball 42 moves in an upward direction as viewed with reference to FIG. 1 of the drawings, this motion is in turn transmitted to the member 38. The member 38 is operatively connected to the float valve 16 through the support 40 whereby when the float ball 42 and the member 38 occupy the dotted line position thereof depicted in FIG. 1 of the drawings, the float valve 16 is in its normally closed position wherein fluid is prevented from flowing therethrough and exiting therefrom through fitting 34 and connecting hose 32. On the other hand, when the member 38 and float ball 42 move to the solid line position thereof, as shown in FIG. 1 of the drawings, this movement is transmitted in a manner well-known to those skilled in the art to cause the float valve 16 to move to its open condition wherein fluild flows through float valve 16. Inasmuch as the structure whereby the aforedescribed interrelationship of the float valve 16 and the float assembly 36 is accomplished is conventional and well-known to those skilled in the art, it has not been deemed necessary to set forth herein with more particularity than that noted above the details of construction thereof. It should also be noted that obviously the amount of movement which the member 38 must experience before it becomes operable to cause the float valve 16 to move from its normally closed position to its open condition can be adjusted without departing from the essence of the invention. Commonly, this is accomplished by adjusting the point of engagement of the member 38 with the support 40 so that the extent to which the float valve 42 is spaced from the support 40 is varied.

With further reference to FIG. 1 of the drawings, as shown therein the other side of the venturi 46 is connected to one end of a length of hose 48. The other end of the length of hose 48 is intended to communicate with a suitable discharge means. Consequently, it can be seen that the length of hose 48 is operable as a means for connecting the other side of the sump drainer 10 to a drain for purposes of discharging water which is withdrawn from the sump hole 12, in a manner yet to be described into a drain. Obviously, the hose 48 is selected so that the length thereof is sufficient to reach from the interior 44 of the sump hole 12 and more specifically the bottom of the latter, to the drain outlet (not shown).

Returning now to a consideration of the nature of the venturi 46, the latter consists of a piece of piping which has a configuration that resembles that of a tee, which is commonly found employed in the plumbing art. More specifically, as best understood with reference to FIG. 1 of the drawings, the venturi siphon 46 has three openings (not shown) formed therein. A first of these openings is in communication with one end of the connecting hose 32 which is operatively connected as previously described, to one side of the venturi 46, while a second of the three openings is similarly in communication with one end of the length of hose 48 which is operatively connected to the other side of the venturi 46. The venturi 46 is provided with a through passage (not shown) which is formed therewithin and which functions to interconnect the aforedescribed first and second of the three openings. The third opening (not shown) with which the venturi siphon is provided is formed in the lower side wall thereof, as viewed with reference to FIG. 1 of the drawings, and connects with the aforereferenced through passage formed in the venturi 46 so as to make a right angle therewith. In a manner yet to be described, it is through the third opening that the water is withdrawn from the sump hole 12. Preferably, an anti-clog screen 50 is suitably mounted, through the use of any suitable conventional form of mounting means, on the venturi 46 in juxtaposed relation to the aforesaid third opening provided therein through which the water in the sump hole 12 is withdrawn as a means of preventing undesired material from accumulating in the aforereferenced third opening and thereby causing a clogging thereof.

Turning now to a more detailed description of the manner in which the venturi 46 functions, as fluid is made to pass through the venturi 46 from the connecting hose 32 to the hose 48, a pressure differential is established across the width of the through passage formed in the venturi 46. As a result, a suction is established across the mouth of the third opening with which the venturi 46 is provided. This suction is effective to cause water to be drawn from the sump hole 12 through the third opening of the venturi 46 into the latter where it becomes entrained with the water flowing through the through passage formed therewithin, and is caused to flow therewith into the hose 48 from whence it is discharged into the drain outlet. As long as the fluid continues to flow through the venturi 46, the latter is effective to cause the water which has been accumulated in the sump hole 12 to be withdrawn therefrom through the venturi 46. The rate at which the water will be withdrawn from the sump hole 12 is a function of the diameter of the third opening which is formed in the venturi 46. Consequently, by selecting a venturi siphon 46 wherein the third opening thereof has a relatively large diameter, an increased rate of flow of the water from the sump hole 12 may be obtained, whereas by employing a venturi siphon 46 wherein the third opening has a smaller diameter a lower flow rate will be obtained.

There will now be set forth a description of the method of employment of the sump drainer 10 constructed in accordance with the present invention. Assuming that water has begun to accumulate in the sump hole 12, and it is desired to insure that flooding of the basement does not result therefrom, the sump drainer 10 may be employed to assure that the latter situation does not occur. To this end, the float valve 16 with the float assembly 36 operatively connected thereto is suitably supported in spaced relation to the sump hole 12 with the float ball 42 located in approximately the position thereof depicted in broken lines in FIG. 1 of the drawings. It is also assumed that one end of the hose 18 has been connected to the inlet of the float valve 16 and that one end of the connecting hose 32 has been connected to the outlet of the float valve 16. In addition, it is assumed that the venturi 16 with the anti-clog screen 50 mounted thereon has one side thereof connected to the hose 32 and the other side thereof connected to one end of the hose 48 so that the venturi 46 is positioned within the interior 44 of the sump hole 12 adjacent the bottom thereof in the manner illustrated in FIG. 1 of the drawings. The other end of the hose 18 to which the flood stopper 22 is connected is then attached to the water spigot 24 while the other end of the hose 48 is made to communicate with a suitable drain outlet. Thereafter, the water spigot 24 is turned ON by means of the handle 26 whereby water flows from the spigot 24 through the flood stopper 22 and the hose 18 to the inlet of the float valve 16. Assuming that the water has not yet risen within the sump hole 12 to a sufficient level to cause the float ball 42 to rise above the position thereof depicted in broken lines in FIG. 1 of the drawings, the float valve 16 will be in its normally closed condition and the water which flows to the float valve 16 from the spigot 24 will not pass therethrough. Thus, the level of the water will continue to rise in the sump hole 12 and as it does the float ball 42 will move therewith. When the float ball 42 reaches approximately the position thereof shown in solid lines in FIG. 1 of the drawings, the movement of the float ball 42 will be transmitted to the member 38 and therethrough to the float valve 16. This operates to cause the float valve 16 to move from its normally closed condition to its open condition. When the latter occurs, the water flowing from spigot 24 is permitted to flow through the float valve 16 and into the connecting hose 32. From the hose 32 the water flows through the venturi 46 therefrom into the hose 48 from whence it is discharged into a suitable drain outlet. As the water passes through the venturi 46, a suction is established therewithin in the manner described in the preceding paragraph, and water will begin to be withdrawn from the sump hole 12 to the venturi 46. The water in the sump hole 12 will continue to be withdrawn therefrom and discharged through the hose 48 as long as water flows through the venturi 46. On the other hand, as the water is withdrawn from the sump hole 12, the level thereof will begin to lower. As the level of the water lowers, the float ball 42 will move downwardly with it. When the float ball 42 once again reaches approximately the position thereof depicted in broken lines in FIG. 1 of the drawings, this movement of the float ball 42 will be operative through the float assembly 36 to cause the float valve 16 to return to its normally closed condition. This will cause water to stop flowing through the venturi 46 which in turn will result in no more water being with drawn from the sump hole 12. The latter condition will be maintained until such time as the water once again reaches a sufficient level in the sump hole 12 to cause the float ball 42 to rise to a position wherein the float valve 16 moves to its open condition whereupon the abovedescribed procedure will be repeated. Assuming that no more water is accumulating in the sump hole 12, the spigot 24 may be turned off and the sump drainer 10 removed from the sump hole 12 until another need therefor arises. From the above description, it should be now readily apparent that the sump drainer 10 constructed in accord with the present invention is operable to drain water which has collected in a sump hole therefrom, and is characterized by the fact that the operation thereof is initiated automatically and does not depend on electricity for its power supply.

Turning now to a consideration of FIGS. 2–7 of the drawings, there is illustrated therein another embodiment of an automatic water powered sump drainer, generally designated by reference numeral 54, constructed in accordance with the present invention. The major components to be found embodied in the automatic water powered sump drainer 54 are valve means 56, a float assembly 58, a venturi 60, means (not shown) connectible to one side of the sump drainer 54 for connecting the latter to a suitable water supply (not shown), means (not shown) connectible to the other side of the sump drainer 54 for connecting the latter to a suitable drain outlet (not shown), and tube means 62 through which the water is drawn from the sump hole.

Proceeding with a detailed description of the individual components embodied in the automatic water powered sump drainer 54, reference will first be had to the valve means 56 thereof. As best understood with reference to FIGS. 2 and 3 of the drawings, the valve means 56 includes a valve body 64. The valve body 64 as shown in the drawings has a generally hexagonally-shaped external configuration, however it is to be understood that the external configuration of the valve body 64 could take some other shape without departing from the essence of the invention. The valve body 64 has formed therein a fluid passage 66, the configuration of which will be described more fully hereinafter, which extends from the inlet side of the valve means 56 to the outlet side thereof. More specifically, the valve body 64 preferably is provided at each end of the fluid passage 66 with a piece of conduit 68 and 70, respectively of relatively short length. The lengths of conduits 68 and 70 can either be formed integrally as part of the valve body 64 or they may consist of separate members which are thereafter suitably affixed to the valve body 64 so as to be in fluid flow communication with the ends of the fluid passage 66 so as to form a unitary unit with the valve body 64. As best understood with reference to FIGS. 2 and 3 of the drawings, the free end of the conduit 68 is preferably provided with internal threads 72 for a purpose yet to be described, while the free end of the conduit 70 is provided with external threads 74. In accord with the intended mode of operation of the automatic water powered sump drainer 54, the free end of the conduit 68 is designed to be connectible by means of the threads 72 to means (not shown) through which the sump drainer 54 is connectible to a suitable water supply. In this regard, the aforereferenced interconnection of the sump drainer 54 to a suitable water supply may be effected by threadedly engaging the threaded end of a length of hose similar to the length of hose depicted in FIG. 1 of the drawings which is identified therein by reference numeral 18 with the threads 72. The other end of such a length of hose it is to be understood would be connected to a suitable water supply in the manner of the hose 18 shown in FIG. 1. Similarly, the other end of the conduit 70 is connectible by means (not shown) to a suitable drain outlet. More specifically, the latter interconnection is accomplished by threadedly engaging one end of a length of hose with the threads 74 with which the free end of the conduit 70 is provided.

Continuing with a description of the nature of the construction of the valve means 56, the valve body 64 is provided with a third opening 76. The latter opening 76 is formed in the base of the valve body 64, as viewed with reference to FIG. 3 of the drawings, and is in fluid flow communication with the fluid passage 66. The function performed by the opening 76 will be described subsequently.

Figure 3:
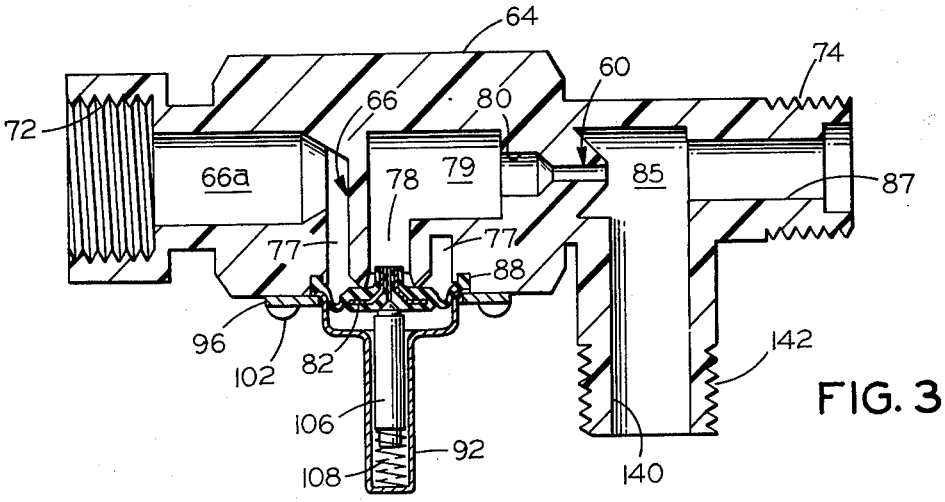
FIG. 3 is a cross sectional view of the valve means of the automatic water powered sump drainer of FIG. 2 constructed in accordance with the present invention, illustrated with the valve means in the closed position.
Figure 5:
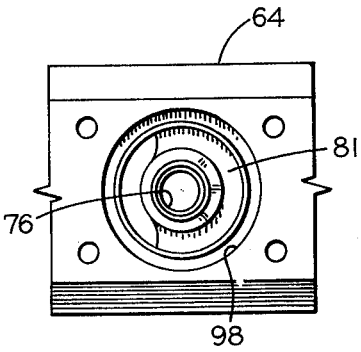
FIG. 5 is a bottom view with parts omitted of a portion of the valve means of the automatic water powered sump drainer of FIG. 2 constructed in accordance with the present invention.
Figure 6:
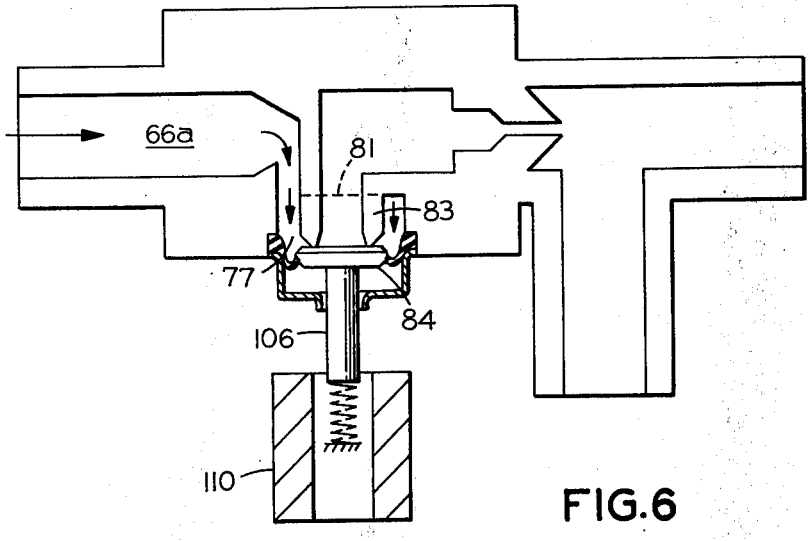
FIG. 6 is a schematic diagram with parts omitted for clarity of illustration of the automatic water powered sump drainer of FIG. 2 constructed in accordance with the present invention illustrating the relationship of the components thereof when the automatic water powered sump drainer is in the closed condition.
Figure 7:
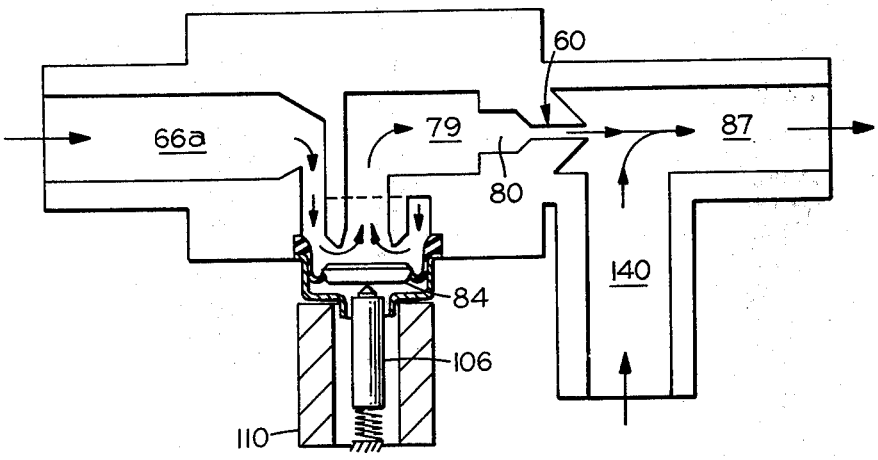
FIG. 7 is a schematic diagram with parts omitted for clarity of illustration of the automatic water powered sump drainer of FIG. 2 constructed in accordance with the present invention illustrating the relationship of the components thereof when the automatic water powered sump drainer is in the open condition.

Turning next to a description of the configuration of the fluid passage 66, the latter as best understood with reference to FIGS. 3, 6 and 7 of the drawings, provides a rather sinuous path through which fluid, i.e., water entering the inlet side of the fluid passage 66 must wend its way before exiting from the outlet side of the fluid passage 66. Namely, as shown in FIG. 3, water entering the conduit 70 flows therethrough and into the horizontal portion 66a of the fluid passage 66. Thereafter, the water flows from the horizontal portion 66a into the vertical portion 77 of the fluid passage 66. As will be described more fully hereinafter, in the non-blocking condition of the fluid passage 66, i.e., as shown in FIG. 7, the water after flowing through the vertical portion 77 flows into another vertical passage 78 formed substantially at the center of the valve body 64. From the vertical passage 78, the water flows into a chamber-like portion 79 of the fluid passage 66, and thereafter to a smaller diameter portion 80 of the fluid passage 66 from whence the fluid flows to and through the venturi means 60. For purposes of better understanding the nature of the construction of the interior of the valve body 64, reference will be had to FIGS. 3, 5, 6 and 7 of the drawings. In this regard, it is to be noted that the vertical portion 77 of the fluid passage 66 consists of a substantially circular opening, the latter fact being illustrated in the drawings through the use of the dotted line 81 appearing in FIGS. 6 and 7, which is separated from the vertical passage 78 by a downwardly projecting flange 83 of generally circular configuration having a hollow interior created by the vertical passage 78.

Referring now to FIG. 3 of the drawings, a resilient diaphragm 84 is supported on the valve body 64 in juxtaposed relation to the opening 76 formed therein. More specifically, the diaphragm 84 is suitably mounted on the valve body 64 so as to be movable into and out of engagement with the free end of the flange 83 for purposes of effecting a blocking of the fluid passage 66 therewith, i.e., to seal the vertical passage 78 from the vertical portion 77 of the fluid passage 66. Namely, it can be said that the diaphragm 84 is movable between a closed position, i.e., a blocking position relative to the fluid passage 66, as depicted in FIGS. 3 and 6 of the drawings, and an open position, i.e., a nonblocking position relative to the fluid passage 66, as depicted in FIG. 7 of the drawings.

As shown in FIG. 3 of the drawings, the diaphragm 84 has an inverted funnel-shaped disc 82, preferably formed of brass, embedded therein. The disc 82 is operable to provide structural strength and stability to the diaphragm 84. Continuing with a description of the nature of the construction of the diaphragm 84, the latter as shown in FIG. 3 is preferably provided with an upwardly projecting circular portion which is receivable in the vertical passage 78 when the diaphragm 84 occupies the closed position thereof. To this end, the diameter of the aforesaid upwardly projecting circular portion must obviously be less than the diameter of the vertical passage 78. Moreover, it is to be noted that for purposes of clarity of illustration the aforedescribed upwardly projecting circular portion of the diaphragm 84 has been omitted from FIGS. 6 and 7 of the drawings. Completing the description of the diaphragm 84, the latter at the center thereof is provided with a through passage of relatively small diameter. In addition, the diaphragm 84 on the side opposite thereof on which the aforereferenced upwardly projecting circular portion is provided has formed therein a cone-shaped recess for a purpose yet to be described. The apex of the latter cone-shaped recess is aligned with the major axis of the through passage formed at the center of the diaphragm 84. As best understood with reference to FIG. 3 of the drawings, for purposes of retaining the diaphragm 84 positioned in juxtaposed relation to the opening 76, the latter is provided with a counterbore. The latter counterbore is suitably dimensioned so as to be capable of receiving therewithin the circumferential rim 88 of the diaphragm 84. As shown in FIGS. 3, 6 and 7 of the drawings, the circumferential rim 88 of the diaphragm 84 for this purpose may embody a substantially rectangular configuration. The circumferential rim 88 of the diaphragm 84 is held captive within the counterbore surrounding the opening 76 formed in the valve body 64 by means of the rim 92 of the armature housing 94. The latter armature housing 94, which is preferably formed of brass, is in turn secured to the valve body 64 by a plate 96, which itself is preferably made of brass. More specifically, the armature housing 94 is supported on the valve body 64 so that the rim 92 thereof is located in juxtaposed relation to the circumference of the opening 76 provided in the valve body 64 and with the body of the armature housing 94 projecting through a suitably dimensioned opening 98 provided for this purpose substantially at the center of the plate 96. For purposes of fastening the plate 96 to the valve body 64, the former adjacent each of the four corners thereof is provided with an opening (not shown) suitably dimensioned so as to be capable of receiving therein a threaded fastener 102. The latter fasteners 102 in turn are threadedly engaged in threaded openings (not shown) provided for this purpose in the valve body 64 so as to be alignable with the openings (not shown) provided in the plate 96.

With regard to the armature housing 94, the latter as depicted in FIG. 3 of the drawings is substantially cylindrical in shape having one end thereof open and the other end closed. The armature housing 94 functions as an enclosure for an armature 106 and a spring 108. The armature 106 has one end thereof formed in the manner of a cone which is suitably configured so as to conform substantially to and be receivable in the cone-shaped recess which as described previously is formed in the base of the diaphragm 84. More specifically, the armature 106 is supported within the armature housing 94 so as to be movable between a first position corresponding to the closed condition of the sump drainer 54 wherein as shown in FIGS. 3 and 6 of the drawings the armature 106 projects outwardly of the armature housing 94 so that the cone-shaped tip of the armature 106 is received in the cone-shaped recess formed in the base of the diaphragm 84 whereby the tip of the armature 106 is operable to close off the through passage with which the diaphragm 84 is provided at the center, and a second position corresponding to the open condition of the sump drainer 54 wherein the armature 106 as shown in FIG. 7 of the drawings is retracted into the armature housing 94 so that the tip of the armature 106 is disengaged from the diaphragm 84. The spring 108 in turn has one end thereof seated against the closed end of the armature housing 94 and the other end thereof seated against the bottom, i.e., the noncone-shaped end of the armature 106, which in accord with the preferred form thereof is constructed so as to be of reduced diameter whereby a portion of the bottom end of the armature 106 is receivable within the aforementioned other end of the armature 106. The spring 108 is operable to normally bias the armature 106 outwardly of the armature housing 94, i.e., to the position thereof depicted in FIGS. 3 and 6 of the drawings which corresponds to the closed condition of the sump drainer 54.

Figure 2:
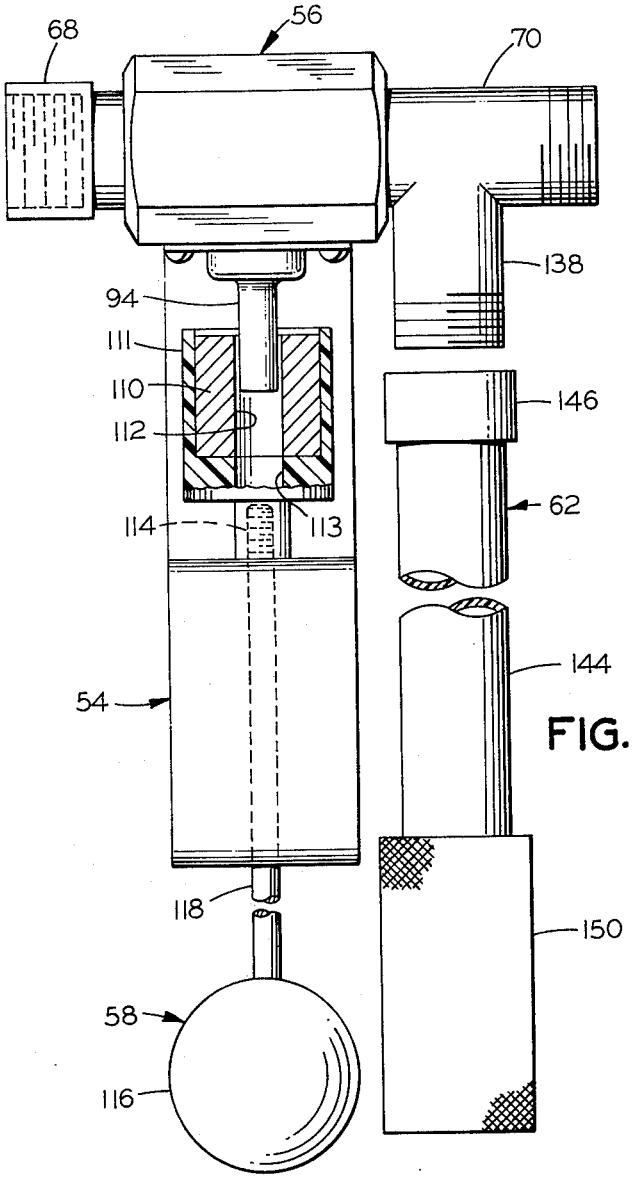
FIG. 2 is a side elevational view with parts broken away of another embodiment of an automatic water powered sump drainer constructed in accordance with the present invention.

Continuing with the description of the nature of the construction of the automatic water powered sump drainer 54 which is depicted in FIGS. 2–7 of the drawings, the former includes a magnet 110. The magnet 110 as best understood with reference to FIG. 2 of the drawings is substantially cylindrical in shape. Moreover, the magnet 110 has formed therein substantially at the center thereof a bore 112 which extends the entire length of the magnet 110. The bore 112 is suitably dimensioned so as to be capable of receiving therewithin the body portion of the armature housing 94. The magnet 110 comprises a permanent magnet which operates to produce a magnetic field, the latter being employed for a purpose yet to be described. Preferably, the magnet 110 is encased within a plastic housing 111. As shown in FIG. 2, the plastic housing 111 also has a bore 113 formed therein which is alignable with the bore 112 provided in the magnet 110. Finally, the plastic housing 111 has preferably formed integrally therewith at the closed end thereof a projection which has a threaded opening 114 formed therein for a purpose which will now be described.

Proceeding now with a description of the float assembly 58, the latter includes a float ball 116 and an elongated member 118. The float ball 116 is affixed to one of the elongated member 118 through the use of any suitable conventional form of fastening means (not shown) commonly employed for purposes of providing a rigid interconnection between a float ball and another member. For instance, in this connection the float ball 116 may be provided with a threaded opening capable of receiving in threaded engagement therewith a threaded end of the elongated member 118. The other end of the elongated member 118 is externally threaded. The latter threads (not shown) are intended to be provided for purposes of threadedly interconnecting the elongated member 118 with the magnet 110, i.e., by threading the end of the elongated member 118 on which the latter referenced threads are formed into the threaded opening 114 formed for this purpose in the plastic housing 111 in which the magnet 110 is encased whereby when movement is imparted to the float ball 116, the latter along with both the elongated member 118 and the magnet 110 will move together as a unit. Although not shown in the drawings in the interest of maintaining clarity of illustration therein, it is to be understood that means are preferably provided for purposes of enabling the spacing between the float ball 116 and the magnet 110, i.e., more specifically the plastic housing 111 to be adjusted. To this end, the elongated member 118 may be of two-part construction so as to enable the length thereof to be adjusted as for instance by permitting one part thereof to be telescoped into the other, or the external threads with which the elongated member 118 is provided at one end thereof may be formed so as to extend a considerable distance along the length of the member 118 whereby the spacing between the float ball 116 and the magnet 110 embedded in the plastic housing 11 may be adjusted by varying the extent to which the threaded end of the elongated member 118 is threaded into the threaded opening 114, etc.

Figure 4:
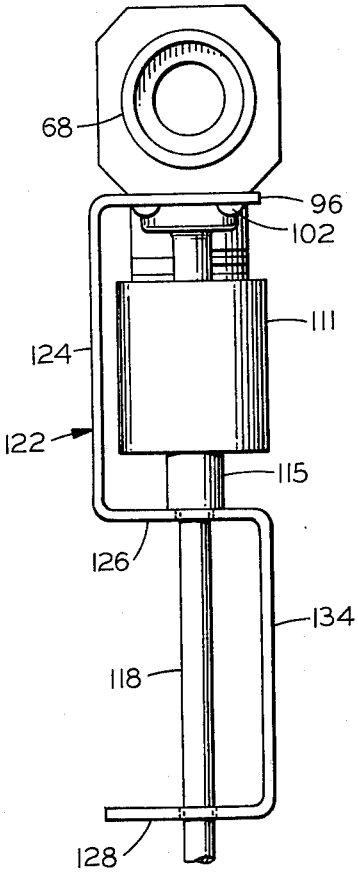
FIG. 4 is an end elevational view of the automatic water powered sump drainer of FIG. 2 constructed in accordance with the present invention, viewed from the inlet side thereof.

For purposes of supporting the assembly consisting of the float ball 116, the elongated member 118 and the magnet 110 embedded in the plastic housing 111, in accord with the illustrated embodiment of the invention the sump drainer 54 is provided with bracket means 122. Referring now to FIG. 4 of the drawings, the bracket means 122 may as depicted therein take the form of a generally S-shaped member consisting of a first leg portion 124, a medial portion 126 and a second leg portion 128. As shown in FIG. 4, the leg portion 124 extends generally vertically. More specifically, one end of the leg portion 124 is preferably formed integrally with the previously described plate 96 whereby the threaded fasteners 102 which function to secure the plate 96 to the valve body 64 are also operative to fasten the bracket means 122 to the valve body 64. As shown in FIG. 5 of the drawings, preferably four threaded fasteners 102 are utilized for purposes of securing the plate 96 and thereby the bracket means 122 to the valve body 64. However, obviously a different number of threaded fasteners 102 could be utilized if so desired without departing from the essence of the present invention. Moreover, rather than being formed integrally with the plate 96, it is also contemplated that the bracket means 122 could be formed independently thereof if so desired, with the bracket means 122 thereafter being either suitably attached to the plate 96 and thereby mounted on the valve body 64 or the bracket means 122 could be separately fastened to the valve body 64. The length of the leg portion 124 is made such as to permit the magnet 110 embedded in the plastic housing 111 to move relative to the armature housing 94 in a manner yet to be described between a first position wherein the magnet 110 is in substantially nonencircling relation relative to the armature housing 94 and a second position wherein the magnet 110 encircles the body of the armature housing 94. The leg portion 124 preferably has the other end thereof formed integrally with one end of the medial portion 126. Moreover, the leg portion 124 as shown in FIG. 4 of the drawings preferably extends substantially at right angles to the medial portion 126. The medial portion 126 serves as a support for the magnet 110 embedded in the plastic housing 111 when the sump drainer 54 is in a nonoperating condition. To this end, the medial portion 126 intermediate the ends thereof is provided with a suitably dimensioned opening capable of enabling the elongated member 118 to be passed therethrough for engagement with the threaded opening 114 formed in the plastic housing 111. In addition, there may be provided on the lower side of the medial portion 126 in juxtaposed relation to the aforereferenced opening formed therein a guide (not shown). The latter guide has not been shown in the drawings in the interest of maintaining clarity of illustration therein. If employed, such a guide is utilized for purposes of guiding the elongated member 118 during the course of the movement thereof relative to the medial portion 126. It will also be understood that after the end of the elongated member 118 has been passed through the opening in the medial portion 126 and has been threadedly engaged in the threaded opening 114, the bracket means 122 functions to support thereon the elongated member 118 and the float ball 116 which is attached to one end of the elongated member 118 in addition to being secured to the plastic housing 111. Completing the description of the nature of the construction of the bracket means 122, the other end of the medial portion 126 is preferably formed integrally with a connecting portion 134 which in turn has one end thereof preferably formed integrally with one end of the second leg portion 128. Accordingly, the medial portion 126, the connecting portion 134 and the leg portion 128 when considered together have a configuration which resembles that of the letter U. More specifically, the connecting portion 134 functions to space the medial portion 126 from the leg portion 128. Moreover, the medial portion 126 and the leg portion 128 preferably lie in planes which extend substantially parallel to each other. In a manner similar to that described hereinabove for the medial portion 126, the leg portion 128 also has an opening formed therein intermediate the ends thereof. The latter referenced opening with which the leg portion 128 is provided is suitably located therein so as to be alignable with the opening formed in the medial portion 126 through which the elongated member 118 extends. As shown in FIG. 4, the elongated member 118 also extends through the opening formed for this purpose in the leg portion 128. Finally, as in the case of the medial portion 126, the leg portion 128 may also be provided with a guide (not shown) suitably formed on the upper surface of the leg portion 128 as viewed with reference to FIG. 4 in juxtaposed relation to the opening formed in the leg portion 128 whereby the latter referenced guide is capable of guiding the elongated member 118 as the latter moves relative to the leg portion 128.

There remain two components which are found embodied in the automatic water powered sump drainer 54 which have not yet been described, namely, the venturi i.e., the venturi stream cone 60 and the tube means 62. The venturi siphon 60 as best understood with reference to FIGS. 3, 6 and 7 takes the form of a venturi stream cone. More specifically, in accord with the illustrated embodiment of the water powered sump drainer 54, the valve means 56 which has the fluid passage 66 formed therein also has the venturi stream cone 60 provided therein. To this end, at the location whereat the conduit 70 joins the valve body 64, the inner side walls of the small diameter portion 80 of the fluid passage 66 converge to form a cone. More specifically, as will be best understood with reference to FIG. 3, the aforereferenced side walls converge so as to substantially reduce further the diameter of the smaller diameter portion 80 of the fluid passage 66. There is thereby provided an orifice in the fluid passage 66 which is of relatively small diameter and which is of relatively short length. On the other side of the latter described orifice, the inner side walls of the fluid passage 66 diverge outwardly and to the rear, i.e., in the direction of the orifice whereby to form another chamber 85 in the fluid passage 66 of substantially the same diameter as the chamber 79. The chamber 85 in turn communicates with a final portion 87 of the fluid passage 66 which terminates in the outlet end of the fluid passage 66. In accordance with the well-known principles of fluid flow, the effect of providing the aforedescribed orifice of reduced diameter in the fluid passage 66 of the valve means 56 is to cause a suction force to be created downstream of the orifice as fluid flowing in the fluid passage 66 encounters and then passes through the orifice. It is this suction force which in a manner yet to be described functions to cause the sump drainer 54 to operate to withdraw water from a sump hole by means of a siphoning action.

Turning now to a consideration of the tube means 62, the latter includes a piece of conduit 138 of relatively short length which depends from the conduit 70 at a point located intermediate the ends of the latter. The conduit 138 is preferably formed integrally with the conduit 70 whereby the through passage 140 with which the former is provided communicate fluidically with the chamber 85 which is formed within the conduit 70. It should be noted here that it is important that as shown in FIG. 3 of the drawings, the point of interconnection of the conduit 138 with the conduit 70 is located downstream of the venturi means, i.e., the venturi 60 so that the suction force created thereby will be effective to cause water to be drawn upwardly through the passage 140 in the conduit 138 and into the chamber 85 formed in the conduit 70. For a purpose yet to be described, the free end of the conduit 138 has external threads 142 formed thereon. In addition to the conduit 138 which has been described above, the tube means 62 further includes a tube member, i.e., a length of pipe 144. The latter described tube member 144 has formed at one end thereof an enlarged portion 146 which is preferably internally threaded. Also, the enlarged portion 146 has an internal diameter suitably dimensioned to permit the conduit 138 to be received therewithin. More specifically, the internal diameter of the enlarged portion 146 is made such as to permit the conduit 138 and the tube member 144 to be connected together through the threaded engagement of the external threads 142 of the conduit 138 with the internal threads of the enlarged portion 146. At the other end thereof, the tube member 144 is preferably provided with an anti-clog screen 150, the latter being attached to the former through the use of any suitable conventional form of attaching means. Inasmuch as the tube means 144 is intended to be inserted into the sump hole to a depth wherein the end thereof to which the anti-clog screen 150 is attached is located below the surface of the water to be withdrawn from the sump hole, the aforedescribed anti-clog screen 150 is preferably utilized for purposes of preventing undesirable material from entering the open end of the tube member 144 and effecting a clogging of the tube means 62. It is also to be understood that the length of the tube means 62 as represented by the combined lengths of the conduit 138 and the tube member 144 is made such as to permit the tube means 62 to extend to the desired distance into the sump hole. In this connection, although not depicted in the drawings in the interest of maintaining clarity of illustration therein, it is also to be understood that the tube means 62 is preferably provided with means operable for enabling adjustments to be made in the length thereof. Such means may take the form of any conventional structure which is commonly found employed for this purpose such as for instance providing the conduit 138 with sufficient external threads 142 whereby the length of the tube means 62 can be adjusted by varying the extent to which the tube member 144 is threaded onto the conduit 138.

As in the case of the automatic water powered sump drainer 10 which was described previously hereinabove, the automatic water powered sump drainer 54 is designed to be supported in juxtaposed relation to a sump hole such as the sump hole 12 shown in FIG. 1 of the drawings, which in turn is suitably provided in the floor 14 of a building. The means utilized for accomplishing the aforereferenced supporting of the sump drainer 54 relative to a sump hole has not been illustrated in the drawings in the interest of maintaining clarity of illustration therein. It is however to be understood that any suitable conventional form of means commonly found employed for purposes of rigidly supporting a device relative to an object could be utilized in this connection. Namely, the sump drainer 54 could, for example, be attached to a suitably configured bracket member which in turn was secured to the floor of the building adjacent an edge of the sump hole. Preferably in order to provide for universality of application of the sump drainer 54, any such bracket means would embody adjusting means operable for permitting the position, etc., of the sump drainer 54 relative to the sump hole to be adjusted. Any suitable conventional form of adjusting means obviously could be employed for purposes of providing a capability wherein the aforereferenced adjustments could be accomplished.

There will now be set forth a description of the mode of operation of the sump drainer 54 constructed in accordance with the present invention. Assuming that water has begun to accumulate in a sump hole such as the sump hole 12 depicted in FIG. 1 of the drawings, and it is desired to ensure that flooding of the basement of the building wherein the sump hole is located does not result therefrom, the sump drainer 54 may be employed to ensure that the latter situation does not occur. To this end, the sump drainer 54 is positioned in juxtaposed relation to the sump hole in supported relation thereto so that the float ball 116 and the anti-clog screen 150 are located in the sump hole so as to be positioned therein adjacent the bottom thereof. For example, the float ball 116 and the anti-clog screen 150 of the sump drainer 54 may occupy the same positions as those depicted in FIG. 1 for the float ball 42 and the anti-clog screen 50 of the sump drainer 10. It is also assumed for purposes of this description that the inlet side of the valve means 56 is connected to a suitable source of water supply. The latter is accomplished for instance through the interconnection of one end of a length of hose to the conduit 68 and the other end thereof to the water supply which may take the form of a water spigot such as the water spigot 24 shown in FIG. 1 of the drawings. In addition, it is assumed that the outlet side of the valve means 56 is connected in fluid flow relation with a suitable drain outlet. The latter connection is preferably effected by connecting one end of a length of hose to the conduit 70 and the other end to the drain outlet. With the aforedescribed components being positioned as described above and-/or connected in the manner described, the water spigot is turned ON so that water flows therefrom through the length of hose connected thereto to the inlet side, i.e., the conduit 68 of the valve means 56 of the sump drainer 54. It should be noted here that it is preferable particularly where the water supply takes the form of a water spigot that a flood stopper be interposed between the water spigot and the length of hose so as to shut off the flow of water in the event that the hose should burst. Assuming that the water has not yet risen within the sump hole to a sufficient level to cause the float ball 116 to undergo any vertical movement, i.e., to move vertically from the position thereof depicted in FIG. 2 of the drawings, the valve means 56 will be in its normally closed position, i.e., the position thereof depicted in FIGS. 3 and 6 of the drawings wherein the armature 106 is in engagement with the diaphragm 84 and is operative to cause the latter to occupy a blocking position relative to the vertical passage 78 effective to prevent the flow of water through the fluid passage 66 formed in the valve body 64. Accordingly, the level of the water will continue to rise in the sump hole and as it does the float ball 116 will move therewith. As the float ball 116 rises relative to the bottom of the sump hole, i.e., moves vertically, this movement of the float ball 116 is transmitted through the elongated member 118 to the plastic housing 111 and thereby also necessarily to the magnet 110 which is encased in the plastic housing 111, causing the magnet 110 to in turn move relative to the body of the armature housing 94. It is to be noted that as the float ball 116 moves vertically and thereby also the elongated member 118 and the plastic housing 111 carrying the magnet 110, all three of these components are guided in their movement by virtue of the fact that the elongated member 118 moves within openings provided for this purpose within the medial portion 126 and the leg portion 128. As the magnet 110 moves vertically into encircling relation relative to the armature housing 94, the armature 106 supported within the armature housing 94 comes under the influence of the magnetic field being produced by the magnet 110. More specifically, a magnetic attraction is established between the magnet 110 and the armature 106 whereby the latter is drawn towards the former. Namely, because of the magnetic attraction between the armature 106 and the magnet 110, the armature 106 is drawn into the armature housing 94 against the bias of the spring 108. Moreover, as the armature 106 retracts into the armature housing 94, the armature 106 and the diaphragm 84 in engagement therewith move from the positions thereof depicted in FIGS. 3 and 6 of the drawings to the positions thereof illustrated in FIG. 7 of the drawings. The effect of this movement is to cause the armature 106 and the diaphragm 84 to move from a blocking position to a nonblocking position relative to the fluid passage 66 in the valve body 64. This operates to cause the valve means 56 to move from its normally closed condition to its open condition. When the latter occurs, the water flowing from the spigot to the inlet side of the valve means 56 is permitted to flow through the fluid passage 66 formed therein to the venturi means 60 and therethrough. As described previously hereinabove, as the stream of water approaches the venturi means 60 it is forced to converge by virtue of the converging nature of the side walls of the fluid passage 66, before flowing through the restricted orifice provided thereat. In accordance with well-know principles of fluid flow, as the stream of water is forced to converge and flow through the restricted orifice, the effect thereof is to cause a suction to be established on the downstream side of the orifice, i.e., the side of the latter whereat the side walls of the fluid passage 66 diverge so that the chambers 79 and 85 located on opposite sides of the orifice are of substantially the same diameter. The aforesaid suction which is produced in the fluid passage 66 adjacent to the venturi means 60 on the downstream side thereof produces a suction in the tube means 62. The effect thereof is to cause the water in the sump hole to be drawn through the anti-clog screen 150 into the tube means 144 and therethrough to the conduit 138 and through the latter to the fluid passage 66 wherefrom the water from the sump hole flows along with the water flowing through the orifice of the venturi means 60 to and through the length of hose which connects the outlet side of the valve means 56 to the drain outlet. The water in the sump hole will continue to be withdrawn therefrom and discharged in the manner just described into the drain outlet as long as water flows through the venturi means 60. On the other hand, as the water is withdrawn from the sump hole the level thereof will begin to lower. As the level of the water lowers, the float ball 116 will move downwardly with it. Concomitant with the downward movement of the float ball 116, there also occurs a downward movement of the elongated member 118 and the plastic housing 111 carrying the magnet 110, both of which are attached to the float ball 116. Moreover, as the magnet 110 moves relative to the armature housing 94 in a direction away from the latter, the effect thereof is to produce a weakening in the magnetic attraction which exists between the magnet 110 and the armature 106 whereby the latter is drawn towards the magnet 110 against the bias of the spring 108. During the course of the downward movement of the magnet 110 relative to the armature housing 94, this movement resulting from the downward movement of the float ball 116 in the sump hole, the magnetic attraction between the magnet 110 and the armature 106 will become sufficiently weakened that the biasing force being applied to the armature 106 by the spring 108 will be strong enough to overcome the aforesaid force of magnetic attraction and thereby cause the armature 106 to move outwardly from the armature housing 94 and into engagement with the diaphragm 84. Namely, the armature 106 under the biasing force being applied thereto by the spring 108 returns to its normal position, i.e., the position thereof depicted in FIGS. 3 and 6 of the drawings which corresponds to the normally closed position of the valve means 56 wherein the diaphragm 84 is caused by the armature 106 to occupy a blocking position relative to the vertical passage 78 thereby preventing a flow of fluid through the fluid passage 66 from the inlet end to the outlet end thereof. Consequently, this will prevent the water from flowing through the fluid passage 66 to the venturi means 60. As a result, the suction is no longer produced downstream of the venturi means 60 in the fluid passage 66 which in turn results in no more water being siphoned from the sump hole through the tube means 62. The latter condition will be maintained until such time as the water once again reaches a sufficient level in the sump hole to cause the float ball 116 to rise to a position wherein the valve means 56 moves to its open condition, i.e., the magnet 110 moves to an encircling position relative to the armature housing 94 whereby the magnetic attraction between the magnet 110 and the armature 106 is sufficiently strong to overcome the biasing force being exerted by the spring 108 on the armature 106 and thereby cause the armature 106 to be retracted into the armature housing 94 wherein the armature 106 is disengaged from the diaphragm 84 enabling the latter to move to a nonblocking position relative to the vertical passage 78 thereby enabling water to flow through the fluid passage 66, whereupon the aforedescribed procedure will be repeated. Assuming that no more water is accumulating in the sump hole, the spigot may be turned OFF and the sump drainer 54 removed from the sump hole until another need therefor arises. From the above description, it should be now readily apparent that the sump drainer 54 constructed in accord with the present invention is operable to drain water which has collected in a sump hole therefrom, and is characterized by the fact that the operation thereof is initiated automatically and does not depend on electricity for its power supply. Moreover, it should be readily apparent that the sump drainer 54 is also characterized by the fact that it is portable and easy to employ. In addition, it can be seen that the sump drainer 54 like the sump drainer 10 is particularly suited for use in applications wherein a need exists for the sump drainer to be temporarily installed during periods when a home owner for one reason or another must be absent from his home, or when in the case of a commercial building the latter will be unoccupied for a relatively short period of time, and it is desired to provide protection against the occurrence of flooding in the basement of the residence or building while the home or commercial building is unoccupied.

Figure 8:
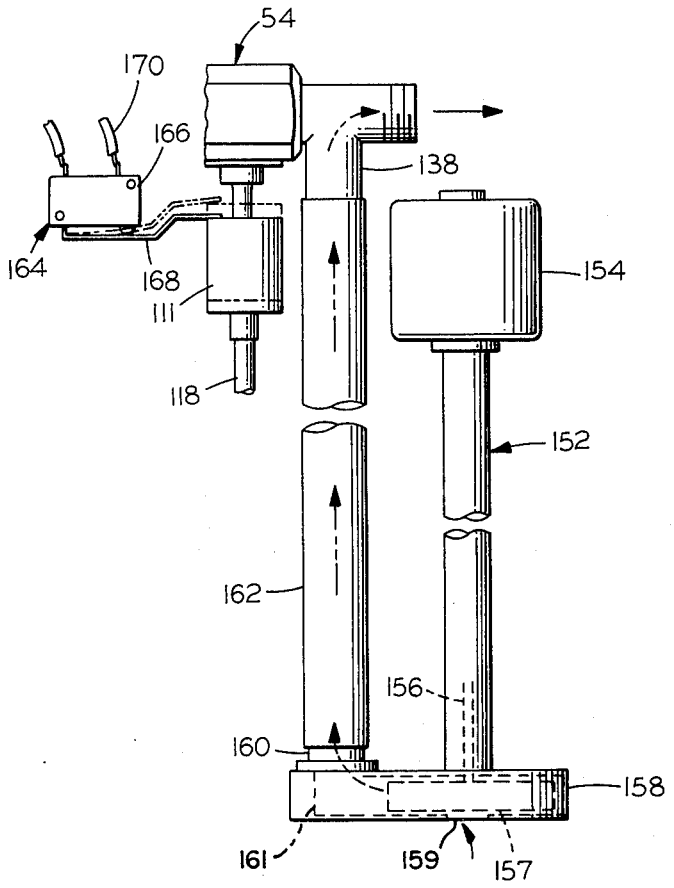
FIG. 8 is a partial side elevational view of the automatic water powered sump drainer of FIG. 2 illustrated cooperatively associated in circuit relation with a conventional sump pump.

Turning now to a consideration of FIG. 8 of the drawings, there is illustrated therein a sump drainer 54 of FIGS. 2–7 of the drawings cooperatively associated with a conventional electrical sump pump 152. For some applications, particularly where a conventional electric pump is permanently mounted in a sump hole so as to always be present in the event that water should begin accumulating in the sump hole, the home dweller or the occupier of a commercial or industrial building may choose to associate the sump drainer 54 with the electric sump pump in order to provide a backup unit to the latter in the event that the electric sump pump malfunctions, or is rendered inoperative by virtue of an electric power outage. For purposes of describing the manner in which the sump drainer 54 of FIGS. 2–7 of the drawings is capable of being combined with a conventional sump pump to provide a fail-safe pumping unit, there has been chosen for illustration in FIG. 8 one particular type of sump pump, i.e., the sump pump 152. However, it is to be understood that the sump pump 152 could take some form other than that shown in FIG. 8 without departing from the essence of the invention.

As shown in FIG. 8, the sump pump 152 includes an electric motor 154 which is operatively connected to one end of a shaft 156 whereby the electric motor 154 is capable of imparting rotation to the shaft 156. At the other end thereof, the shaft 156 has an impeller 157 fixedly mounted thereon. The latter referenced impeller is mounted within the base 158 of the sump pump 152 so as to be capable of rotation therein. In addition, the base 158 is provided on the bottom surface thereof with an opening 159 which forms the inlet to a fluid passage 161 formed in the base 158 whereby water may be drawn into the base 158 through the aforesaid opening and then caused to flow through the aforedescribed fluid passage 161 in the base 158 whereupon the water exits from the outlet pipe 160 which is provided on the upper surface of the base 158. In accord with conventional practice, and in a manner well-known to those skilled in the art, the water is drawn into the base 158 as a result of the rotation of the impeller housed therewithin, with the impeller in turn being driven through the shaft 156 from the electric motor 154. Inasmuch as the sump pump 152 is of conventional construction, and accordingly embodies components which are well-known to those skilled in the art, it is not deemed necessary to describe herein in further detail, apart from the description thereof found set forth hereinabove, the nature of the structure with which the sump pump 152 is provided. Rather, it is deemed sufficient to merely note at this point that in accord with the conventional method of use of the sump pump 152, the latter is supported in juxtaposed relation to a sump hole so that the base 158 thereof is located adjacent to the bottom of the sump hole and with the motor 154 being positioned above the level to which the water in the sump hole will be permitted to rise if the sump pump 152 functions properly. A further point to be noted here is that the base 158 of the sump pump 152 will commonly be spaced somewhat from the bottom of the sump hole so as to ensure that the opening 159 formed in the bottom surface of the base 158 will remain accessible for water present in the sump hole to enter therein. Preferably, the latter described opening 159 in the base 158 is covered by an anti-clog screen to prevent undesirable material from being drawn into the base 158 and thereby effecting blockage of the fluid passage 161 provided in the base 158.

With regard now to the sump drainer 54, where it is desired to combine the latter with a conventional sump pump such as for instance the sump pump 152 of FIG. 8, a need exists to take into consideration two minor changes in the structural relationship of the components embodied in the sump drainer 54. In this connection, reference is had to the fact that the tube means 62 of the sump drainer 54 is not employed in the case wherein the latter is cooperatively associated with a conventional sump pump, and the fact that switch means are utilized in connection with the sump drainer 54 whereby the switch means is caused to be actuated by the latter. Considering first the omission of the tube means 62, the latter as illustrated in FIG. 8 of the drawings is replaced by a piece of tubing 162 which has one end thereof attached to the conduit 138 of the sump drainer 54 and the other end thereof attached to the outlet pipe 160 of the sump pump 152. The ends of the piece of tubing 162 can be connected to the conduit 138 and the outlet pipe 160, respectively, in any suitable manner. For instance, the ends of the piece of tubing 162 may be suitably dimensioned so as to permit the free end of the conduit 138 and the free end of the outlet pipe 160 to be inserted therewithin and retained therein by means of a frictional engagement therebetween. On the other hand, the piece of tubing 162 may take the form of a length of pipe, the opposite ends of which are internally threaded whereby one end of the pipe is capable of being threadedly fastened to the conduit 138 through the threaded interengagement of the internal threads of the length of pipe provided at one end thereof with the external threads 142 provided at the free end of the conduit 138. In a similar fashion, the free end of the outlet pipe 160 could be externally threaded whereby the connection of the other end of the length of pipe 162 and the outlet pipe 160 is accomplished through the threaded interengagement of the internal threads of the length of pipe 162 which are provided at the other end thereof with the external threads with which the free end of the outlet pipe 160 may for this purpose be provided.

In accord with the preferred method of associating the sump drainer 54 with the sump pump 152, the former is preferably utilized for purposes of initiating the operation of the latter. To this end, switch means 164 are preferably connected in electrical circuit relation with the electric motor 154 of the sump pump 152 whereby the operation of the electric motor 154 and thereby the sump pump 152 is controlled by means of the switch means 164. Moreover, the switch means 164 in turn is preferably mechanically actuated through the operation of the sump drainer 54. More specifically, in accord with the illustrated embodiment thereof as found depicted in FIG. 8 of the drawings, the switch means 164 consists of a conventional microswitch 166 actuated by means of a leaf spring 168, and a pair of electrical conductors 170, each having one end thereof connected in electrical circuit relation with a corresponding one of the terminals of the microswitch 166 and the other end thereof (not shown) connected in electrical circuit relation with a corresponding one of the terminals of the electric motor 154. Moreover, it will be noted with reference to FIG. 8 of the drawings that the switch means 164 is supported relative to the sump drainer 54 whereby the free end of the leaf spring 168 is positioned in the path of movement of the plastic housing 111 in which the magnet 110 is encased so as to be engageable therewith as the plastic housing 111 is caused to move upwardly as viewed with reference to FIG. 8.

With reference to FIG. 8 of the drawings, there will now be set forth a description of the manner in which the sump drainer 54 and the sump pump 152 function as a unit when cooperatively associated together. For purposes of this discussion, it will be assumed that the sump pump 152 has been positioned relative to the sump hole so that the base 158 thereof is supported within the sump hole in slightly spaced relation to the bottom thereof. In addition, it will be assumed that the electric sump pump 152 has been connected in electrical circuit relation with a suitable electrical power supply (not shown). Insofar as concerns the sump drainer 54, it will be assumed that the latter is supported relative to the sump hole, either by being secured directly onto the sump pump 152 or by being supported by suitable bracket means in the manner which has been described hereinabove in connection with the discussion of the nature of the construction and the mode of operation of the sump drainer 54 illustrated in FIGS. 2–7 of the drawings, wherein the float ball 116 is located within the sump hole. Moreover, it will be assumed that the conduit 68 of the sump drainer 54 is connected by suitable means in fluid flow relation with a suitable source of water and that the conduit 70 of the sump drainer 54 is connected by suitable means to a drain outlet. Finally, as shown in FIG. 8 of the drawings, it will be assumed that the conduit 138 of the sump drainer 54 and the outlet pipe 160 of the sump pump 152 are fluidically interconnected by means of the tubing 162, and that the switch means 164 is suitably supported relative to the sump drainer 54 so that the free end of the leaf spring 168 is located in the path of movement of the plastic housing 111 in which the magnet 110 is encased. With the sump drainer 54 and the sump pump 152 mounted relative to the sump hole in the aforedescribed manner, and the components thereof each bearing the aforedescribed relationship relative to the other components embodied in the sump drainer 54 and the sump pump 152, the unit consisting of the sump drainer 54 and the sump pump 152 stands prepared for operation.

Assuming now that water begins to accumulate in the sump hole, the water will continue to rise therein and will have no effect on the operation of the unit consisting of the sump drainer 54 and the sump pump 152 until the water within the sump hole has risen to a sufficient level to produce vertical movement of the float ball 116. When the water in the sump hole reaches a level sufficient to engage float ball 116, any further increase in the amount of water present in the sump hole will cause the float ball 116 to rise thereafter with the level of the water. As the float ball 116 rises relative to the bottom of the sump hole, i.e., moves vertically, this movement of the float ball 116 is transmitted through the elongated member 118 to the plastic housing 111 in which the magnet 110 is encased, thus causing the latter to also move upwardly, i.e., vertically as viewed with reference to FIG. 8 of the drawings. Moreover, since the free end of the leaf spring 168 is positioned in the path of movement of the plastic housing 111, the latter as it is caused to travel upwardly carries with it the free end of the leaf spring 168. Namely, assuming that the free end of the leaf spring 168 and the upper surface of the plastic housing 111 bear the relationship relative to each other which is depicted in FIG. 8 of the drawings when the float ball 116 has not yet begun to undergo vertical movement resulting from a rise in the level of the water in the sump hole, as the level of the water in the sump hole rises which in turn produces the subject vertical movement of the float ball 116 and concomitant therewith the upward travel of the plastic housing 111, the latter being schematically depicted in FIG. 8 through the use of broken lines, the free end of the leaf spring 168 is also caused to move to the broken line position thereof shown in FIG. 8. When the free end of the leaf spring 168 reaches a position thereof depicted in broken lines in FIG. 8, the effect thereof is to cause an actuation of the microswitch 166. In this connection, it will be assumed that when the leaf spring 168 occupies the position thereof shown in solid lines in FIG. 8 that the microswitch 166 is in a normally open condition and thus the electric motor 154 of the sump pump 152 is in a nonrunning condition, and when the leaf spring 168 occupies the position thereof shown in broken lines in FIG. 8, the microswitch 166 is actuated, i.e., moved to the closed condition thereof whereby the electrical circuit therethrough to the electric motor 154 of the sump pump 152 is completed and the electric motor 154 begins running thereby causing the shaft 156 and the impeller 157 mounted thereon to rotate. Therefore, with the leaf spring 168 now occupying the position thereof depicted in FIG. 8 of the drawings, the sump pump 152 is actuated as a result of the closing of the electrical circuit thereto through the microswitch 166. More specifically, the impeller 157 being driven from the electric motor 154 begins to rotate. As the impeller 157 rotates, water is drawn from the sump hole into the base 158 of the sump pump 152 through the opening 159, previously described, which is provided in the bottom surface of the base 158. The water after entering the base 158 flows therein through the fluid passage 161 which as described previously terminates at the outlet pipe 160. Upon reaching the outlet pipe 160, the water flows therefrom into the tubing 162 and therethrough to the conduit 138 of the sump drainer 54. From the conduit 138, the water flows into the chamber 85 of the fluid passage 66 and thence completes its flow through the conduit 70 to the outlet end of the valve means 56 whereupon the water flows through the means whereby the conduit 70 is connected to a suitable drain outlet and is discharged into the drain outlet. It is to be noted here that as the water is being pumped from the sump hole by virtue of the action of the impeller 157 of the sump pump 152 and is caused to flow through the tubing 162 and thus through the conduits 138 and 70 of the sump drainer 54, the fluid passage 60 formed in the valve means 56 remains blocked, i.e., water entering the conduit 68 of the valve means 56 is prevented from entering the vertical passage 78 of the fluid passage 66 because of the presence of the diaphragm 84. Namely, the diaphragm 84 continues to occupy its normal position, i.e., the position thereof shown in FIGS. 3 and 6 of the drawings, because the armature 106 is being biased by the spring 108 into engagement with the diaphragm 84 thereby causing the latter to engage the portion 83 formed at the center of the valve body 64.

Assuming now that for some reason the sump pump 152 malfunctions, or electrical power thereto is lost whereby although the leaf spring 168 has been caused to move to the position thereof depicted in FIG. 8 of the drawings, which in turn is operative to actuate the microswitch 166, the electric motor 154 remains in its nonoperating state. Consequently, since the electric motor 154 is not running, the impeller 157 does not rotate and therefor water is not pumped thereby from the sump hole. Accordingly, the level of the water in the sump hole will continue to rise, and thus produce further vertical movement of the float ball 116. As the float ball 116 continues to move vertically the plastic housing 111 and thereby the magnet 110 encased therein will be carried upwardly with it. Because of the inherent resiliency which is possessed by the leaf spring 168, the latter without any damage being done thereto will be moved upwardly by the upper surface of the plastic housing 111 beyond the position thereof depicted in broken lines in FIG. 8 of the drawings. The upward movement of the float ball 116 and thus the plastic housing 111 and the magnet 110 continues until the magnet 110 reaches substantially the position thereof relative to the armature housing 94 which is illustrated in FIG. 7 of the drawings. At this point, the sump drainer 54 in the manner described previously in connection with the description of the structure shown in FIGS. 2–7 of the drawings becomes operative to cause water to be drawn from the sump hole and made to flow to a suitable drain outlet whereat the water is discharged. Namely, as the magnet 110 continues to move upwardly beyond the dotted line position of the plastic housing 111 depicted in FIG. 8 of the drawings and into encircling relation relative to the armature housing 94, the armature 106 supported within the armature housing 94 comes under the influence of the magnetic field being produced by the permanent magnet 110. More specifically, a magnetic attraction is established between the magnet 110 and the armature 106 whereby the latter is drawn towards the former. Therefore, because of the magnetic attraction between the armature 106 and the magnet 110, the armature 106 is drawn into the armature housing 94 against the bias of the spring 108. Moreover, as the armature 106 retracts into the armature housing 94, the armature 106 and the diaphragm 84 move from the positions thereof depicted in FIGS. 3 and 6 of the drawings to the positions thereof illustrated in FIG. 7 of the drawings. The effect of this movement is to cause the armature 106 and the diaphragm 84 to move from a blocking position to a nonblocking position relative to the vertical passage 78 of the fluid passage 66 in the valve body 64. This operates to cause the valve means 56 to move from its normally closed condition to its open condition. When the latter occurs, the water flowing to the inlet side of the valve means 56 whereupon it enters the conduit 68 is permitted to flow through the fluid passage 66 formed in the valve means 56 to the venturi means 60 and therethrough. Moreover, as the stream of water approaches the venturi means 60 it is forced to converge by virtue of the converging nature of the side walls of the fluid passage 66 before flowing through the restricted orifice provided thereat. Furthermore, as the stream of water is forced to converge and flow through the restricted orifice, the effect thereof is to cause a suction to be established on the downstream side of the orifice. The aforesaid suction which is produced in the fluid passage 66 adjacent to the venturi means 60 on the downstream side thereof produces a suction in the conduit 138. The effect thereof is to cause the water in the sump hole to be drawn into the base 158 of the sump pump 152 through the opening 159 provided in the bottom surface thereof, then through the fluid passage 161 in the base 158 whereupon it exits from the outlet pipe 160 into the tubing 162, flows through the tubing 162 into the conduit 138 and through the latter to the fluid passage 66 wherefrom the water from the sump hole flows along with the water flowing through the orifice of the venturi means 60 to and through means which connects the outlet side of the valve means 56 to the drain outlet. The water in the sump hole will continue to be withdrawn therefrom and discharged in the manner just described into the drain outlet even though the sump pump 152 is inoperative, as long as water flows through the venturi means 60. As the water is withdrawn from the sump hole the level thereof will begin to drop. Also, as the level of the water lowers, the float ball 116 will move downwardly with it. Concomitant with the downward movement of the float ball 116 there also occurs a downward movement of the elongated member 118 and the magnet 110, both of which are operatively connected to the float ball 116. Moreover, as the magnet 110 moves relative to the armature housing 94 in a direction away from the latter, the effect thereof is to produce a weakening in the magnetic attraction which exists between the magnet 110 and the armature 106. At some point in the aforereferenced downward movement of the magnet 110, the magnetic attraction between the magnet 110 and the armature 106 will become sufficiently weakened that the biasing force being applied to the armature 106 by the spring 108 will be strong enough to overcome the aforesaid force of magnetic attraction and thereby cause the armature 106 to move outwardly from the armature housing 94 and engage the diaphragm 84 causing the latter to move to a blocking condition relative to the vertical passage 78, i.e., to the position thereof depicted in FIGS. 3 and 6 of the drawings. In turn, this will prevent the water from flowing through the fluid passage 66 to the venturi means 60. As a result, the suction is no longer produced downstream of the venturi means 60 in the fluid passage 66 which in turn results in no more water being drawn from the sump hole through the base 158 of the sump pump 152, the outlet pipe 160, the tubing 162, and the conduits 138 and 70 of the sump drainer 54. The latter condition will be maintained until such time as the water once again reaches a sufficient level in the sump hole to cause the float ball 116 to rise to a position wherein the valve means 56 moves to its open condition, whereupon the aforedescribed procedure will be repeated. Assuming that no more water is accumulating in the sump hole, the sump drainer 54 will remain in an inoperative state until there is once again a need therefor.

From the above, it should be readily apparent that the sump drainer 54 when cooperatively associated with a conventional sump pump 152 is capable of functioning as a backup unit, i.e., as a safety means in the event that a malfunction therein or an electrical power outage renders the conventional sump pump 152 inoperative. Moreover, it is to be understood that when the sump drainer 54 is combined with the sump pump 152 to form a unit therewith, water being drawn from the sump hole by means of the unit will always, i.e., even when the water is being pumped from the sump hole by the action of the sump pump 152, enter the conduit 138 of the sump drainer 54 and pass therefrom through the conduit 70 to the means connecting the latter to the drain outlet and be discharged in the drain outlet. It is also to be understood that although the sump drainer 54 is depicted in FIG. 8 of the drawings as being associated in accord with a particular arrangement with the sump pump 152 that the desired cooperation between the sump drainer 54 and the sump pump 152 could be effected in other ways without departing from the essence of the invention. For instance, rather than positioning the switch means 164 so that it is engaged by the upper surface of the plastic housing 111, the switch means 164 could take some other form and be actuated by engagement directly with the float ball 116. Moreover, if so desired the switch means 64 could be omitted all together. In such a case, actuation of the sump pump 152 could be effected in a variety of different ways, for instance through the movement of a second float ball which is associated with the sump pump 152. Namely, the float ball 116 could be utilized solely for purposes of initiating the operation of the sump drainer 54 in the event that the sump pump 152 for one reason or another does not function upon the level of the water within the sump hole reaching a predetermined level. To this end, if the sump drainer 54 and the sump pump 152 are each equipped with its own float ball, then preferably the float ball 116 of the sump drainer 54 would be spaced at a greater distance from the bottom of the sump hole than is the float ball of the sump pump 152 in order to permit operation of the sump pump 152 to be initiated first through movement of its float ball before the water in the sump hole reaches a sufficient level to effect initiation of the sump drainer 54 through movement of the float ball 116. Obviously, it is also possible if so desired without departing from the essence of the present invention to connect the microswitch 166 in electrical circuit relation with some form of battery powered audible warning means, the latter being operative when the level of the water in the sump hole rises to a sufficient extent to cause initiation of the operation of the sump drainer 54 to provide some form of warning sound such as the ringing of a bell, etc.

Although two embodiments of the automatic water powered sump drainer constructed in accordance with the present invention have been shown in the drawings and described hereinabove, it is nevertheless to be understood that still other modifications in the construction thereof may be made thereto by those skilled in the art without departing from the essence of the invention. In this connection, some of these other modifications which can be made in the subject automatic water powered sump drainer have been alluded to hereinabove while others will become readily apparent to those skilled in the art when exposed to the present description and illustration of the construction of the automatic water powered sump drainer 10 and the automatic water powered sump drainer 54. For example, as noted previously the water supply which is employed to power the sump drainer 10 or the sump drainer 54 may be provided from some means other than a water spigot without departing from the essence of the invention. Moreover, where it is desired to employ the sump drainer 10 or the sump drainer 54 as a permanent installation, it may be found desirable to substitute piping for the various lengths of hose which have been described hereinabove as being employed for purposes of effecting connections between the water supply and the inlet side of the valve portion of the corresponding sump drainer and between the outlet side thereof and the drain outlet. This substitution of piping for lengths of hose could obviously be accomplished without departing from the essence of the invention.

There are a number of advantageous features possessed by the automatic water powered sump drainer constructed in accord with the present invention. For instance, the automatic water powered sump drainer of the present invention is operative as a positive ON-OFF water supply valve. Also, in contradistinction to conventional plumbing valves, no mechanical linkages are required to be employed with the automatic water powered sump drainer of the present invention. Moreover, the automatic water powered sump drainer of the present invention is rendered operative by even a relatively small rise in the level of the water in the sump hole, e.g., a rise of one-half inch in the water level. In addition, the automatic water powered sump drainer of the present invention is advantageously characterized in that it is much lighter in weight than all other similar types of devices, and is completely portable. Also, the automatic water powered sump drainer of the present invention is small enough to fit into any sump hole capable of having mounted therein an electric sump pump. Furthermore, the automatic water powered sump drainer 54 as described previously herein is capable of being installed in such a sump hole without removing the sump pump. More specifically, the automatic water powered sump drainer of the present invention is designed to fit into small holes which are as small as six inches in diameter. Additionally, the automatic water powered sump drainer of the present invention is advantageously characterized in that it is very inexpensive to produce in comparison with other similar types of devices. Finally, the automatic water powered sump drainer of the present invention can be employed as a remote unit, i.e., does not have to be installed in a sump hole to be manually operated.

Thus, it can be seen that the present invention provides a novel and improved sump drainer which is operable to drain water which has collected in a sump hole provided in the basement floor of a building therefrom. Moreover, in accord with the present invention a sump drainer has been provided wherein the operation thereof is capable of being automatically initiated upon the occurrence of some predetermined condition. The automatic water powered sump drainer of the present invention employs water as a power source and therefore remains operative during periods of electrical power outages. Furthermore, an automatic water powered sump drainer has been provided in accord with the present invention which is readily compatible with the existing equipment to be found in present buildings, be the latter in the nature of a residential building or a commercial building, thereby enabling the sump drainer of the present invention to be installed therein without necessitating either extensive modification of existing equipment or the addition of new equipment. Also, in accord with the present invention an automatic water powered sump drainer has been provided which is capable of being easily installed in a building by the average person. Finally, the automatic water powered sump drainer of the present invention is characterized by the fact that it embodies components which are presently commercially available.

Having thus described the invention, I claim:

1. An automatic water powered sump drainer operable for removing water from a confined area comprising:

a. valve means supported in spaced relation adjacent to and externally of the confined area, said valve means including a valve body having a fluid passage formed therein, inlet means provided at one end of said fluid passage, outlet means provided at the other end of said fluid passage, said inlet means being connectible to an external water supply for supplying water as a power source to the sump drainer, said outlet means being adapted for connection to a drain outlet for discharging water from the sump drainer into the drain outlet, said valve means further including armature means and having an opening formed in said valve body with one end of said opening communicating with said fluid passage intermediate the ends thereof, said armature means being supported relative to said opening for movement between a first position wherein said armature means is effective to block the flow of water through said fluid passage and a second position wherein said armature means permits water to flow through said fluid passage from said inlet means to said outlet means, said valve means having a first operating condition wherein the flow path in said fluid passage through said valve means between said inlet means and said outlet means thereof is interrupted when said armature means occupies said first position thereof and a second operating condition wherein an uninterrupted flow path is established in said fluid passage through said valve means between said inlet means and said outlet means thereof when said armature means occupies said second position thereof;

b. a float assembly operatively connected to said valve means for controlling the movement of said armature means between said first and second positions thereof and thereby the movement of said valve means between said first and second operating conditions thereof, said float assembly including float means supported within the confined area for movement therewithin in response to a change in the water level within the confined area, said float assembly further including magnet means operable for producing a magnetic field, said magnet means being operatively connected to said float means for movement therewith between a first position wherein said armature means lies outside the effective range of the magnetic field of said magnet means and a second position wherein said armature means lies within the effective range of the magnetic field of said magnet means, said float means being movable between a first position within the confined area wherein said magnet means occupies said first position thereof, said armature means occupies said first position thereof and said valve means is in said first operating condition thereof, and a second position within the confined area wherein said magnet means occupies said second position thereof, said armature means is caused to move from said first position to said second position thereof as a result of the magnetic attraction created between said magnet means and said armature means and said valve means is thereby caused to occupy said second operating condition thereof;

c. venturi means provided in said fluid passage of said valve means at a point therealong located between said opening in said valve body and said outlet means for receiving a flow of water therethrough when said armature means occupies said second position thereof and said valve means is in said second operating condition thereof, said venturi means being operable when water flows therethrough to produce a suction force in said fluid passage on the downstream side of said venturi means; and d. tube means having one end thereof connected to said valve means and the other end thereof positioned below the level of the water in the confined area, said tube means having said one end thereof connected in fluid flow relation with said fluid passage in said valve means at a point therealong located in juxtaposed relation to the downstream side of said venturi means so as to be exposed to the suction force produced by said venturi means when water flows therethrough, said tube means being operable to draw water from the confined area therethrough by means of suction force produced by said venturi means to which said tube means is exposed and to discharge the water drawn from the confined area into said fluid passage for subsequent discharge into the drain outlet.

2. The automatic water powered sump drainer as set forth in claim 1 wherein said armature means comprises an armature housing, a spring, a diaphragm and an armature, said armature housing having an open end and a closed end and being mounted on said valve means with said open end of said armature housing positioned in juxtaposed relation to said opening in said valve body, said spring being positioned in said armature housing with one end thereof seated against said closed end of said armature housing, said diaphragm being mounted in said valve means so as to be movable therewithin between an interrupting position and a noninterrupting position relative to said fluid passage, said armature being supported within said armature housing for movement relative thereto, said armature having one end thereof engageable with said diaphragm to cause said diaphragm to move therewith when said armature is caused to move between said first and second positions of said armature means relative to said fluid passage in said valve means, said spring having the other end thereof seated against the other end of said armature for applying a biasing force to said armature tending to bias said armature to said first position of said armature means.

3. The automatic water powered sump drainer as set forth in claim 2 wherein said magnet means comprises a cylindrically-shaped permanent magnet having a bore formed therein operable for receiving therewithin said armature housing when said magnet means is moved to said second position thereof, and a plastic housing operable as a casing for said cylindricallyshaped permanent magnet.

4. The automatic water powered sump drainer as set forth in claim 1 wherein said float assembly further includes an elongated member having one end thereof connected to said magnet means and the other end thereof connected to said float means, said elongated member being operable to operatively interconnect said magnet means and said float means for movement together as a unit.

5. The automatic water powered sump drainer as set forth in claim 4 wherein said float means of said float assembly comprises a float ball attached to said other end of said elongated member.

6. The automatic water powered sump drainer as set forth in claim 1 wherein said venturi means comprises a restricted orifice formed within said fluid passage in said valve means, said restricted orifice being formed by the convergence of the side walls of said fluid passage located on the upstream side of said restricted orifice and by the divergence of the side walls of said fluid passage located on the downstream side of said restricted orifice.

7. The automatic water powered sump drainer as set forth in claim 1 further comprising bracket means operable for supporting said float assembly on said valve means.

8. The automatic water powered sump drainer as set forth in claim 7 wherein said bracket means includes a first leg portion operatively connected to said valve means, a medial portion extending at right angles to said first leg portion and having one end thereof formed integrally with one end of said first leg portion, a connecting portion extending at right angles to said medial portion and parallel to said first leg portion and having one end thereof formed integrally with the other end of said medial portion, and a second leg portion extending at right angles to said connecting portion and parallel to said medial portion and having one end thereof formed integrally with the other end of said connecting portion, said float assembly being supported in depending relation from said bracket means for movement relative thereto.

9. The automatic water powered sump drainer as set forth in claim 1 wherein said tube means comprises a length of conduit having one end thereof formed integrally with said valve means and a tube member having one end detachably secured to the other end of said length of conduit and the other end thereof located below the level of the water in the confined area.

10. The automatic water powered sump drainer as set forth in claim 9 further comprising an anti-clog screen mounted on said other end of said tube member and operable to prevent the accumulation in said tube means of undesired material capable of effecting a clogging thereof.

11. The automatic water powered sump drainer as set forth in claim 9 wherein said tube member has the other end thereof fluidically interconnected to the outlet of a sump pump.

12. The automatic water powered sump drainer as set forth in claim 11 further comprising switch means connected in electrical circuit relation with the sump pump having the outlet thereof connected to said other end of said tube member and operable for controlling the actuation of the sump pump, said switch means having an unactuated position effective to place the sump pump in a nonpumping condition and an actuated position effective to place the sump pump in a pumping condition, said switch means being supported in the path of movement of said magnet means for engagement thereby to cause said switch means to move between said unactuated position and said actuated position thereof.

13. A fail-safe pumping unit operable for removing water from a confined area comprising:

a. a sump pump including a motor, a shaft having one end thereof drivingly connected to said motor for rotation thereby, an impeller mounted on the other end of said shaft for rotation therewith, a base housing said impeller and having a fluid passage provided therein, said fluid passage having an inlet formed at one end thereof and an outlet formed at the other end thereof, said sump pump being supported in juxtaposed relation to the confined area with said impeller positioned within the confined area adjacent to but spaced from the bottom thereof;

b. switch means connected to said sump pump and operable for controlling the actuation of said sump pump, said switch means having an unactuated position effective to place the sump pump in a nonpumping condition and an actuated position effective to place the sump pump in a pumping condition;

c. an automatic water powered sump drainer including valve means, a float assembly and venturi means, said valve means including a valve body having a fluid passage formed therein, said fluid passage having inlet means provided at one end thereof and outlet means provided at the other end thereof, said inlet means being connectible to an external water supply for supplying water as a power source to said sump drainer, said outlet means being adapted for connection to a drain outlet for discharging water from said sump drainer into the drain outlet, said valve means further including movable means and having an opening formed in said valve body with one end of said opening communicating with said fluid passage intermediate the ends thereof, said movable means being supported in said opening in said valve body for movement between a first position wherein said movable means is effective to block the flow of water through said fluid passage in said valve body and a second position wherein said movable means permits water to flow through said fluid passage in said valve body from said inlet means to said outlet means, said valve means having a first operating condition wherein the flow path in said fluid passage through said valve means between said inlet means and said outlet means thereof is interrupted when said movable means occupies said first position thereof and a second operating condition wherein an uninterrupted flow path is established in said fluid passage through said valve means between said inlet means and said outlet means thereof when said movable means occupies said second position thereof, said float assembly being operatively connected to said valve means for controlling the movement of said movable means between said first and second positions thereof and thereby the movement of said valve means between said first and second operating conditions thereof, said float assembly including float means supported within the confined area for movement therewithin in response to a change in the water level within the confined area, said venturi means being provided in said fluid passage of said valve means at a point therealong located between said opening in said valve body and said outlet means for receiving a flow of water therethrough when said movable means occupies said second position thereof and said valve means is in said second operating condition thereof, said venturi means being operable when water flows therethrough to provide a suction force in said fluid passage in said valve body on the downstream side of said venturi means;

d. tube means having one end thereof connected to said outlet of said sump pump, said tube means having the other end thereof connected in fluid flow relation to said fluid passage formed in said valve means to complete a fluid flow path through said tube means from said inlet of said fluid passage in said base of said sump pump to said outlet means provided at one end of said fluid passage formed in said valve body, said tube means having said other end thereof connected to said fluid passage of said valve means at a point therealong located in juxtaposed relation to the downstream side of said venturi means so as to be exposed to the suction force produced by said venturi means when water flows through said venturi means; and e. actuator means mounted on said float means for movement therewith, said actuator means being operatively associated with said switch means to effect movement thereof between said unactuated position and said actuated position thereof and being operatively associated with said movable means to control the movement thereof between said first and second positions thereof, said actuator means being movable between a first operating position wherein said switch means occupies said unactuated position thereof and said movable means occupies said first position thereof, a second position wherein said switch means occupies said actuated position thereof and said movable means occupies said first position thereof, and a third position wherein said switch means occupies said actuated position thereof and said movable means occupies said second position thereof, said float means being movable to a first position within the confined area wherein said actuator means occupies said first position thereof, said switch means occupies said unactuated position thereof and said movable means occupies said first position thereof corresponding to the nonpumping condition of the fail-safe pump unit, said float means being movable to a second position within the confined area by the rise of the water therein wherein said actuator means occupies said second position thereof, said switch means occupies said actuated position thereof, said movable means occupies said first position thereof and water is drawn by the operation of said sump pump from the confined area through said fluid passage in said sump pump, through said tube means, through a portion of said fluid passage in said valve means located downstream of said venturi means and is discharged into the drain outlet, and said float means being movable to a third position within the confined area by the rise of the level of the water therein wherein said actuator means occupies said third position thereof, said switch means occupies said actuated position thereof but if said sump pump fails to operate, said movable means occupies said second position thereof and water is drawn by means of the suction force produced by said venturi means of said sump drainer from the confined area through said fluid passage in said sump pump, through said tube means, through the portion of said fluid passage in said valve means located downstream of said venturi means and is discharged into the drain outlet.

* * * * *